US006511152B2

(12) United States Patent
Yoshimura

(10) Patent No.: US 6,511,152 B2
(45) Date of Patent: Jan. 28, 2003

(54) INKJET PRINTER WITH CLEANING MEANS

(75) Inventor: Tsuyomi Yoshimura, Fukui (JP)

(73) Assignee: Seiren Co., Ltd., Fukui (JP)

( * ) Notice: Subject to any disclaimer, the term of this patent is extended or adjusted under 35 U.S.C. 154(b) by 0 days.

(21) Appl. No.: 09/817,794

(22) Filed: Mar. 27, 2001

(65) Prior Publication Data

US 2001/0028372 A1 Oct. 11, 2001

(51) Int. Cl.[7] ..... B41J 2/165
(52) U.S. Cl. ..... 347/33
(58) Field of Search ..... 347/1, 22, 104, 347/33; 101/424, 425

(56) References Cited

U.S. PATENT DOCUMENTS 4,985,733 A * 1/1991 Kurotori et al. ..... 399/156
5,345,863 A * 9/1994 Kurata et al. ..... 101/126
5,432,539 A * 7/1995 Anderson ..... 347/33
5,574,485 A * 11/1996 Anderson et al. ..... 347/27
5,732,631 A * 3/1998 Walther et al. ..... 101/424

FOREIGN PATENT DOCUMENTS

JP 11-192694 A * 7/1999 ..... B41J/2/01

* cited by examiner

*Primary Examiner*—Anh T. N. Vo
(74) *Attorney, Agent, or Firm*—Kanesaka & Takeuchi

(57) ABSTRACT

An inkjet printer includes an endless belt to convey a fabric to be stuck onto the surface thereof, an inkjet head for ejecting ink onto the fabric, and a cleaning device for washing the surface of the endless belt after removal of the fabric therefrom. The cleaning device has a cleaning brush moving back and forth for brushing the endless belt in the direction at right angles to that of the movement of the endless belt, a nozzle for supply a cleaning solution to the cleaning brush, and a suction nozzle for sucking residues left on the surface of the endless belt, such as ink, cleaning water, fluff and yarn waste, after the washing thereof for removal of the residues. The inkjet printer can be made compact, and cost and maintenance can be improved.

9 Claims, 4 Drawing Sheets

INKJET PRINTER WITH CLEANING MEANS

BACKGROUND OF THE INVENTION AND RELATED ART STATEMENT

The invention relates to an inkjet printer for ejecting ink onto a recording medium made of a fiber structure to form images on the recording medium, and more particularly to an inkjet printer equipped with means for cleaning the surface of supporting means for supporting the recording medium.

At present, an attention has been made to an inkjet printing system, which can be used as a method for printing on a recording medium, such as a fibrous structure, by ejecting ink onto the recording medium to form images on it, from the textile industry for its effective application in small-lot multi-variety production.

The inkjet printing system is generally based on a printing mechanism, wherein a recording medium is held onto the surface of supporting means by adhesive or other similar means and is conveyed to a specified position; and ink is ejected or discharged from an inkjet head onto the recording medium for printing. If the recording medium is a thin cloth, net or other similar fabric, ink penetrates through the fabric to stain the supporting device, resulting in staining the fabric itself.

In addition, when ink is applied to the recording medium, such as fabric, the inkjet printing system requires the fabric to be securely stuck or adhered onto the surface of the supporting device during the ink ejection process. Therefore, when any fluff, yarn and other debris is left onto the surface of the supporting means or belt, the fabric may fail to stick securely onto the supporting device at the position where the debris is present. As a result, the fabric raises at the affected portion, causing the printing of the fabric to become uneven.

For the above-described reasons, the conventional printing machine, such as flat screen printing and rotary screen printing machines, for the recording medium with a fiber structure, in which the supporting means is provided to convey the recording medium stuck onto the surface thereof during the printing process, is normally equipped with a device as illustrated in FIG. 4 for cleaning the surface of the supporting means after detachment of the recording medium therefrom.

In FIG. 4, this cleaning device is designed to clean means for supporting the recording medium represented as an endless belt 30. The belt 30 is sprayed with water from a cleaning water injection nozzle 31, and is then contacted with a plurality of cleaning brush rolls 32 for removal of any residues deposited onto belt 30, such as color paste, fluff and yarn. Then, water left on the belt 30 is removed by scraping with a rubber doctor blade 33, and the belt 30 passes between press rolls 34 for further removal of water left on the belt 30 to clean the belt 30 and restore the stickiness on the surface thereof to its original state.

On the other hand, as disclosed in Japanese Patent Publication (KOKAI) No. 11-192694, there is an inkjet printer with cleaning means proposed for application in printing a recording medium with a fiber structure. This prior art inkjet printer is formed of a conveyer unit comprising means for supporting and conveying a recording medium as an endless belt, and means for driving the belt; a printing unit comprising an inkjet print head for injecting ink onto the recording medium conveyed by the endless belt; a recovery unit where the printed recording medium conveyed by the endless belt from the printing unit is detached from the endless belt for recovery; and a cleaning unit for washing the endless belt after the detachment of the recording medium therefrom in the recovery unit. The cleaning unit has a wiping roller, the surface of which is at least made of a porous polymer.

As one of the features, the above publication points out that the cleaning unit, because it has a wiping roll, the surface of which is at least composed of a porous polymer, is capable of removing water left on the endless belt together with any residue deposited thereon derived from the recording medium during the printing process, and that the wiping roll need not be replaced on a periodic basis.

According to the description of the above publication, however, the wiping roller is rotated while the porous polymer surface of the roller is pressed against the endless belt only for rubbing the belt in its conveying direction. This suggests that the wiping roller may have a sufficient force to scrape off any liquid material left on the belt such as water and ink, but not to remove any solid material stuck onto the belt, such as dust and yarn derived from the recording medium.

In addition, the wiping roller of such a sort as proposed in the above prior art must have a width enough to cover the width of the endless belt, so that the diameter thereof must be enlarged to a considerable extent, thus requiring a large space for its installation. This may promote to design a wiping roller of a similar type with its width and diameter both reduced, which, however, only results in providing more than one roller on the endless belt in its conveying direction, resulting in requiring a large space in that direction.

Eventually, the above-mentioned prior art cleaning unit has a disadvantage that it uses a large amount of water for cleaning the belt and requires its equipment, such as a brush for such cleaning, to be enlarged in size and using a large space for installation of the equipment, which, in turn, causes problems with its cost and maintenance.

The invention disclosed herein has been made to solve the above-mentioned problems involved in the prior art, and it is an object of the present invention to provide an inkjet printer, not only excellent in cost and maintenance, but also compact in structure, which is designed to ensure secure removal of any residues left on a belt for supporting a recording medium, such as fluff and yarn derived from the recording medium.

It is another object of the invention to provide an inkjet printer as stated above, which can assure stabilized quality of the resultant printed goods.

Further objects and advantages of the invention will be apparent from the following description of the invention.

SUMMARY OF THE INVENTION

Specifically, the present invention provides an inkjet printer comprising supporting means designed to convey a recording medium as stuck onto the surface thereof, printing means for ejecting ink onto the recording medium stuck onto the surface of the supporting means, and cleaning means for washing the surface of the supporting means after detachment of the recording medium therefrom. The cleaning means has suction means for drawing any residues left on the surface of the supporting means after the washing for removal of the residues.

In addition, the inkjet printer of the present invention has the following features.

The cleaning means is capable of moving or reciprocating back and forth in a direction perpendicular to or diagonal to the direction in which the supporting means is conveyed.

The cleaning means is also equipped with a brush for cleaning the surface of the supporting means and a nozzle for supplying a cleaning solution to the brush.

The cleaning means may be equipped with a porous structure for cleaning the surface of the supporting means and a nozzle for supplying a cleaning solution to the porous structure.

The cleaning means may be equipped with a fibrous structure for cleaning the surface of the supporting means and a nozzle for supplying a cleaning solution to the fibrous structure.

The suction means is located downstream of the cleaning means relative to the moving direction of the supporting means in such a way that the tip of the suction nozzle of the suction means faces the surface of the supporting means.

The cleaning means moves back and forth across the supporting means at a speed of 10 to 100 mm/sec.

The cleaning means according to the present invention is equipped with the suction means designed to securely remove any residues on the surface of the supporting means after the detachment of the recording medium, such as the fibrous structure therefrom, including not only liquid materials, such as printing ink and cleaning water, but also solid materials, such as fluff, yarn and dust, derived from the recording medium. In addition, because of the suction means provided as one of the features, the cleaning means has an advantage over the wiping roller type cleaning device described herein earlier as prior art in that it requires less periodic replacement, less installation space and far less maintenance, as well as no contact with the adhesive layer of the supporting means, causing far less damage to it.

According to the present invention, the cleaning means is equipped with a cleaning brush to apply physical brushing onto the supporting means by moving back and force in the direction perpendicular or diagonal to the direction in which the supporting means is conveyed. The brush moving direction, however, is preferably perpendicular to the supporting means conveying direction for the following reason.

The supporting means according to the present invention is coated with a sticky layer on its surface by a publicly known adhesive agent or sheet, such as based on a water-soluble, pressure-sensitive resin or heat-sensitive resin, to cause the recording medium, such as fabric, to stick securely onto the surface of the supporting means while the recording medium is printed.

During the inkjet printing process, the supporting means is subjected to repeated attachment and detachment of the recording medium, causing the surface of its sticky layer to become irregular with the depressed portions of the irregular sticky layer surface resultantly liable to collect liquid material, such as the ink penetrated through the recording material. The removal of the liquid material collected in such depressed portions of the sticky layer, as discovered by the inventor of the present invention, can be achieved more efficiently with a smaller amount of a cleaning solution by applying the brushing operation on the supporting means in the same direction as the inkjet head is scanned, that is, in the widthwise direction of the supporting means, rather than in its longitudinal direction as proposed in the prior art. In addition, the direction of moving the brush as proposed in the present invention is advantageous in that it only requires a relatively small stroke to push the solid materials left on the supporting means, such as fluff and yarn waste, from its center to its both ends.

According to the present invention, the cleaning means is not limited only to a brush as conventionally used for such cleaning, but can include a porous structure or fibrous structure such as cloth, which is to be selected properly according the type of the fabric to be printed as a recording medium, the cleaning condition to be applied and other factors to be considered in the inkjet printing process.

The suction means provided in the cleaning means according to the present invention preferably has the tip of its suction nozzle facing the surface of the supporting means at a position adequately adjusted to make a small gap therebetween.

According to the present invention, the adjustment of the gap between the tip of the suction nozzle of the suction means and the supporting means to be small allows suction air in the gap to have an increased velocity, thereby causing the cleaning solution to become atomized in a finer state to allow it to be more easily drawn into the suction nozzle for its removal. Experiments for the present invention have shown that the gap between the tip of the suction nozzle and the supporting means can be preferably set in the range of 0.2 to 5.0 mm.

As described above, the cleaning means of the present invention is designed to minimize the deterioration in the stickiness of the sticky layer on the surface of the supporting to means and to allow secure removal of any residues left on the supporting means after the detachment of the recording medium therefrom, including not only liquid materials, such as the ink and cleaning water waste, but also solid materials, such as fluff, yarn and dust, constituting the greatest problem in inkjet printing, thereby restoring the stickiness of the supporting means to make its surface condition proper for the next attachment of the recording medium.

DETAILED DESCRIPTION OF PREFERRED EMBODIMENTS

Figure 1:
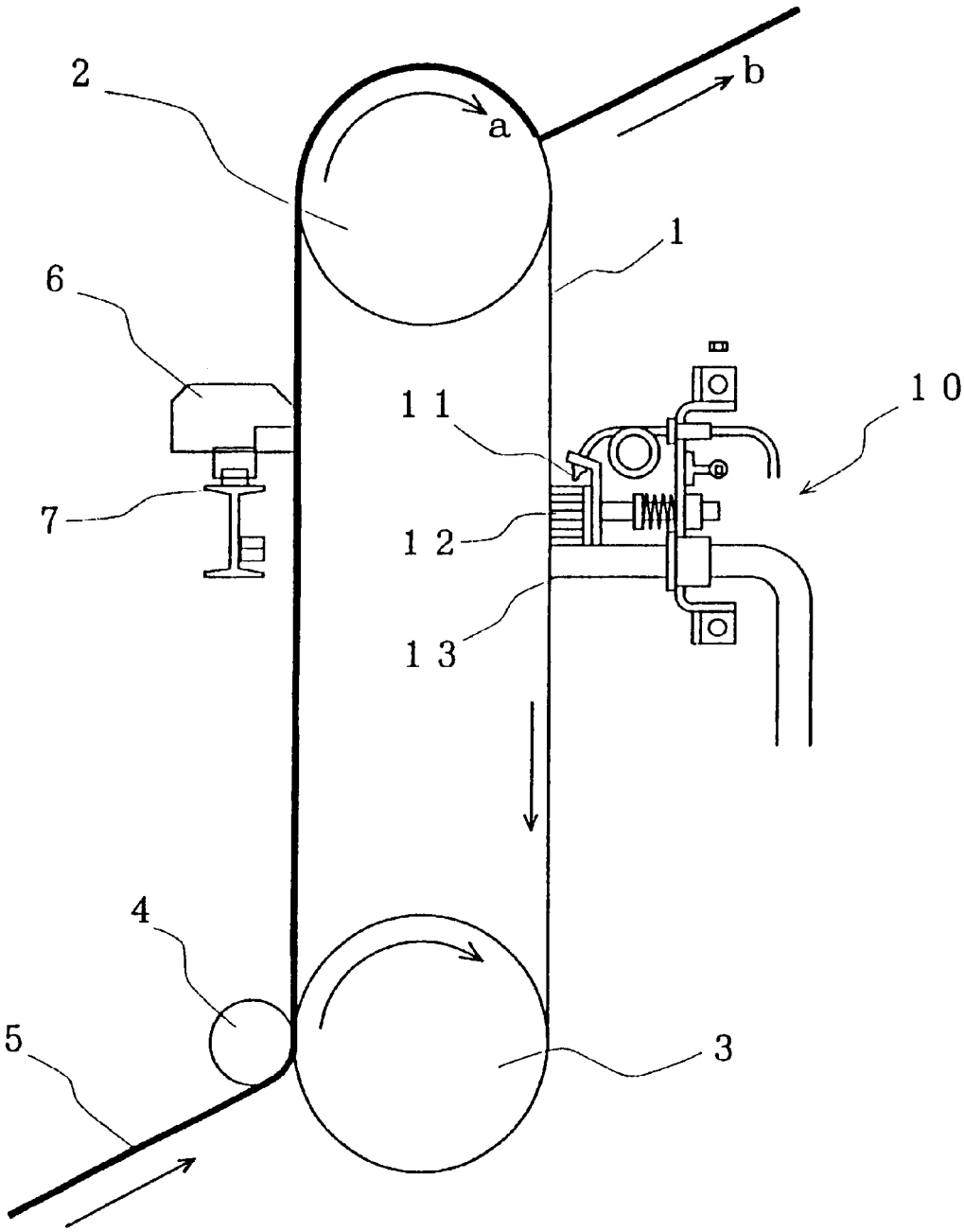
FIG. 1 is a side view of an inkjet printer of the present invention, showing its general configuration.
Figure 2:
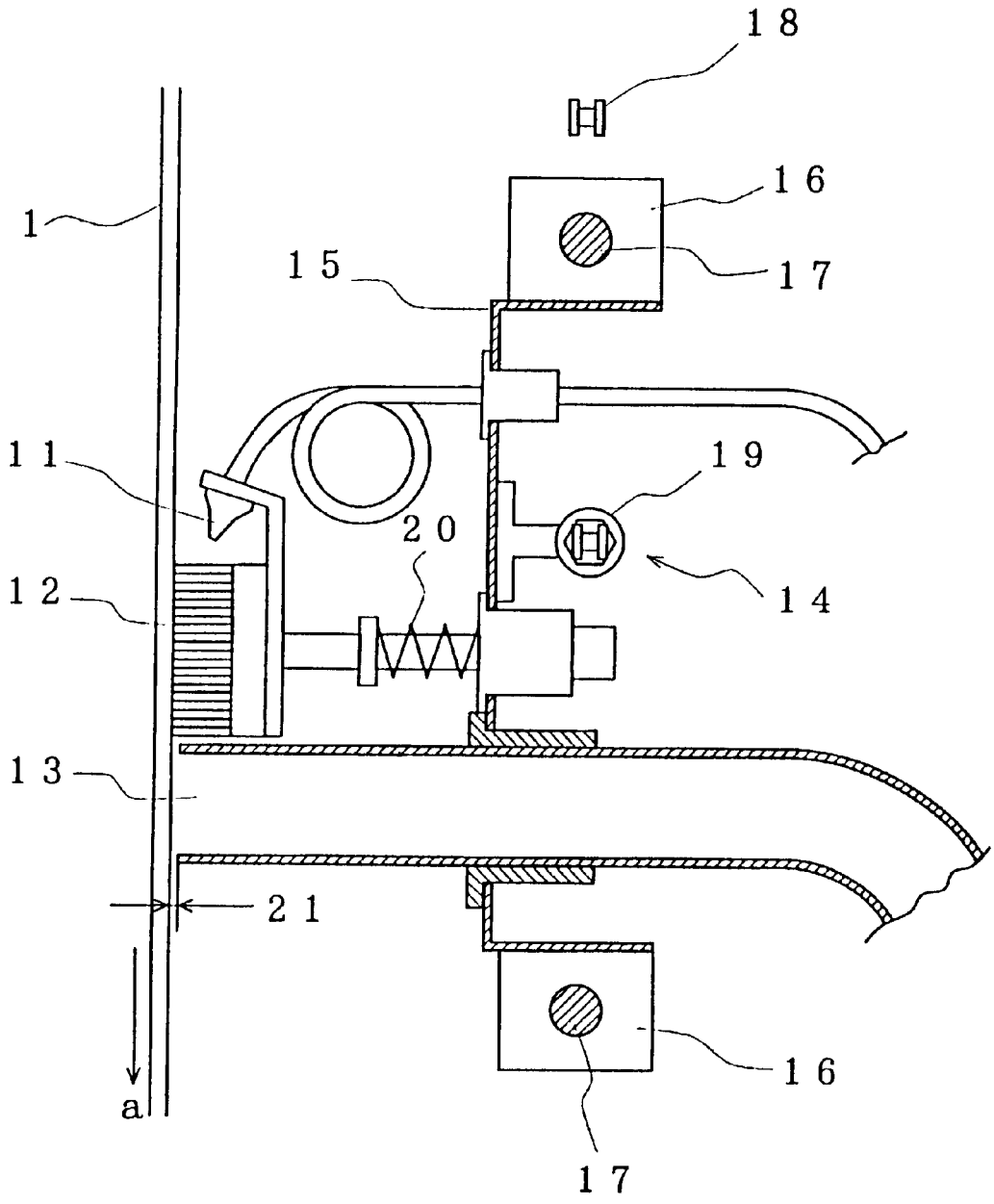
FIG. 2 is a side view, partly in cross section, of cleaning means illustrated in FIG. 1.
Figure 3:
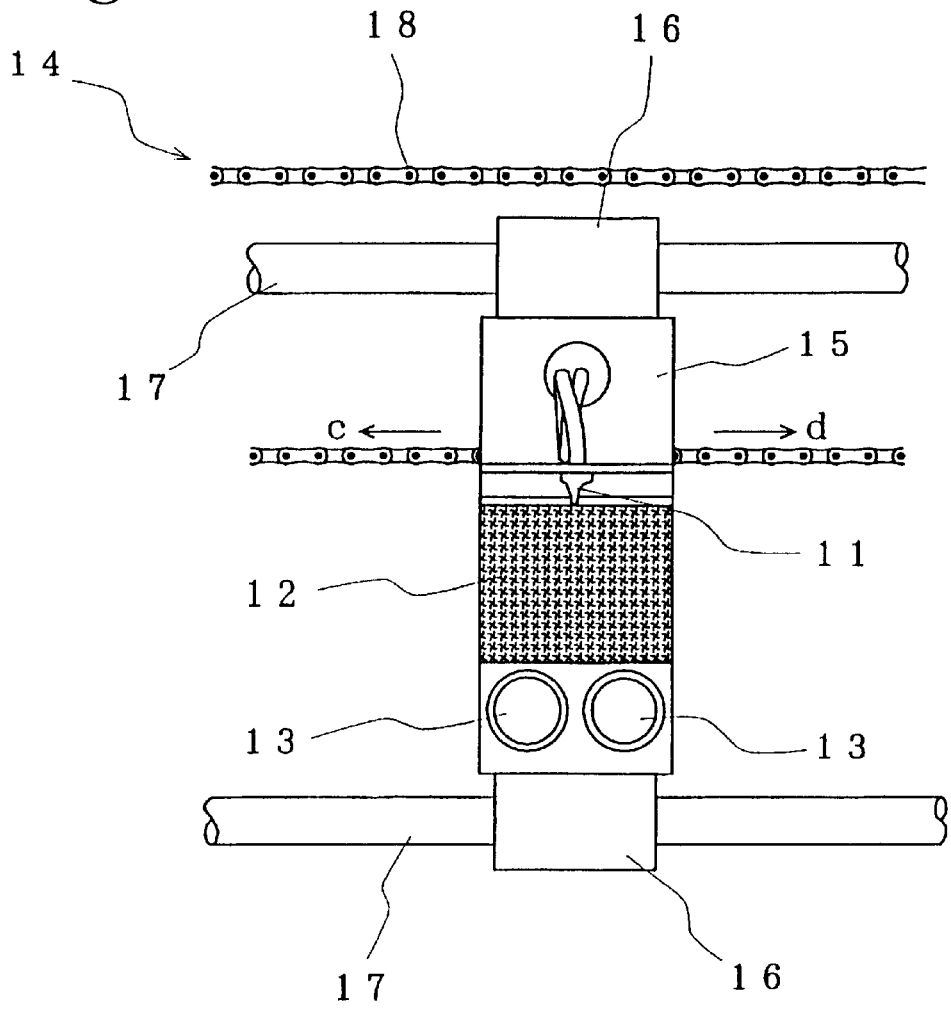
FIG. 3 is a front view of the cleaning means of the present invention.
Figure 4:
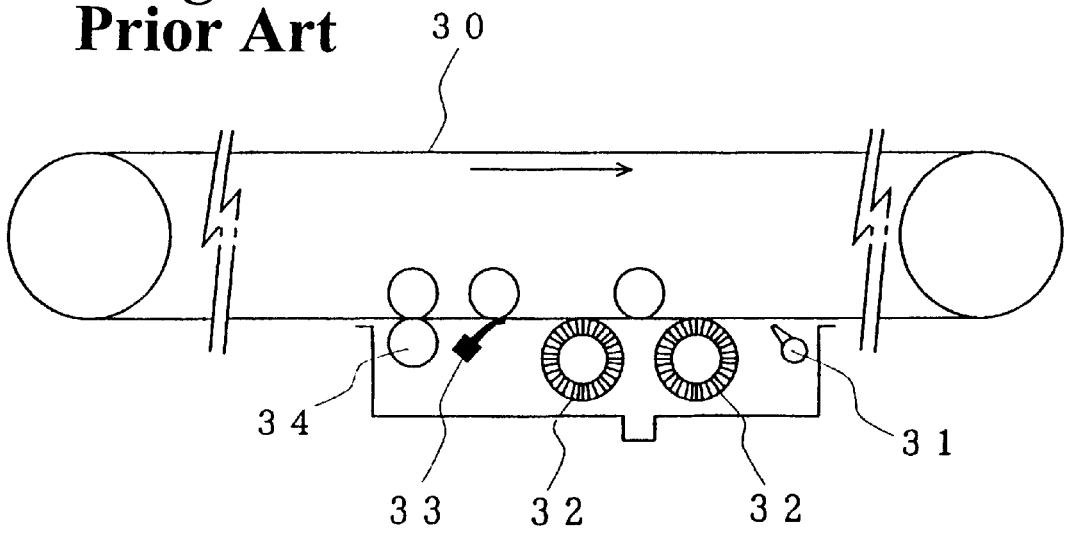
Fig. 4 Prior Art
FIG. 4 is a diagram of the cleaning unit provided in a conventional printing machine.

Embodiments of the present invention will be described below by way of examples with reference to the accompanying drawing to make it more understandable. FIG. 1 is a side view of an inkjet printer of the present invention, showing a general configuration. FIG. 2 is a side view, partly in cross section, of cleaning means illustrated in FIG. 1. FIG. 3 is a front view of the cleaning means of the present invention.

Referring to FIG. 1, an endless belt 1 as means for supporting a recording medium is wound around a driving roller 2, and a driven roller 3 to cause the endless belt 1 to rotate in the direction indicated by an arrow. The endless belt 1 has a sticky layer on an outer surface. In addition, the endless belt 1 is equipped with a tension mechanism (not shown) to control the tension of the belt at a constant level.

On one of the linear movement sides (shown in the figure as the side where it moves upward in a vertical direction), the endless belt 1 has a press roller 4 provided against the driven roller 3 to insert fabric 5 between both rollers.

The fabric 5 to be printed with images is drawn out from a roller (not shown) and is inserted between the press roller 4 and the driven roller 3, at which the press roller 4 presses the fabric against the driven roller 4 at a given pressure in such a way that it is not creased, causing it to be adhered onto the surface of the endless belt 1.

The fabric 5 thus stuck onto the surface of the endless belt 1 is conveyed in a vertical direction as an integral part of the endless belt 1 and is injected with ink from an inkjet head 6 provided at a proper position along the endless belt 1. The inkjet head 6 is loaded on a slide rail to allow it to move in the horizontal direction at right angles to that of the movement of the fabric 5 (which corresponds to the front-to-back direction of the sheed in FIG. 1). The inkjet head 6 ejects ink onto the fabric in sequence according to its movement on the slide rail specifically adjusted to the rotation of the endless belt 1 to print specified images on the fabric.

After leaving the inkjet head 6 with the specified images printed onto it, the fabric 5 moves around the driving roller 2 before being detached from the endless belt 1, and drawn in the direction indicated by an arrow "b", so that it is dried and then taken up on a roll (not shown).

After the printed fabric is detached from the endless belt 1, the endless belt 1, as mentioned herein earlier, has a liquid material, such as ink, and solid materials, such as fluff, yarn and dust, stuck onto its surface. To remove such liquid and solid materials stuck on its surface, a cleaning device 10 is provided at a proper position of the endless belt 1 on its backward side thereof.

As illustrated in FIGS. 2 and 3, the cleaning device 10 is formed of a cleaning solution supply nozzle 11, a cleaning brush 12, a suction nozzle 13 and a drive mechanism 14 to move these devices 11–13 back and forth in the direction at right angles to that of the conveyance of the endless belt 1, i.e. the widthwise direction.

The cleaning solution supply nozzle 11, cleaning brush 12 and suction nozzle 13 are supported on a frame 15 of the cleaning device 10. The frame 15 is supported through upper and lower slide bearings 16 by support bars 17 provided at right angles to the direction of the conveyance of the endless belt 1.

The drive mechanism 14 is composed of a chain 18 wound round a chain wheel, for example, with the ends of the chain being connected to fixtures 19 mounted on the frame 15 of the cleaning device 10. Accordingly, the rotation of the chain 18 in the forward or backward direction causes the cleaning device 10 to move in the direction indicated by an arrow "c" or "d". According to the present invention, the speed of the movement of the cleaning device 10 is preferably set in the range of 10 to 100 mm/sec. In addition, the cleaning device 10 is controlled to move synchronously with the intermittent rotation of the endless belt 1.

The cleaning brush 12 is pressed against the endless belt 1 at a specified pressure properly adjusted by a spring 20 and moved back and forth on the endless belt 1 in its widthwise direction to clean it by brushing. The cleaning brush 12 according to the present invention can be made from any selected material, including, but not limited to, horsehair, unless the selected material of the brush interferes in achieving the purpose of the present invention.

The cleaning brush 12 is located below the cleaning solution supply nozzle 11, so that a cleaning solution is dropped on the brush 12. The cleaning solution of the present invention can comprise purified water or water containing a detergent or water-soluble solvent. Experiments for determining the amount of the cleaning solution to be drop-wise supplied to the brush show that its drop-wise supply to the brush at a considerably small rate of 10 to 80 cc/min is sufficiently effective in achieving the purpose of the present invention. In addition, according to the present invention, the cleaning solution supply nozzle 11 can be preferably protected against air clogging by providing an deaerator or air vent on a line.

The suction nozzle 13 is located just below the cleaning brush 12. In this embodiment of the present invention, two of the suction nozzles 13 are provided, which are arranged side by side in the widthwise direction of the endless belt. The suction nozzle 13 is positioned in relation to the endless belt 1 with a clearance 21 between the tip of the nozzle and the surface of the belt. The clearance 21 is adjusted to be small according to the capacity of the suction device (not shown) such as its air flow and pressure. Experiments made in this connection to achieve the purpose of the present invention have shown that the clearance 21 can be preferably set in the range of 0.2 to 5.0 mm. The suction nozzle 13 of the present invention can be shaped in any selected form including, but not limited to, round and rectangular, unless the selected shape of the nozzle interferes in achieving the purpose of the present invention.

The cleaning device 10 configured as described above according to the present invention is driven by the chain 18 to move back and forth on the endless belt 1 in its widthwise direction, so that the cleaning brush 12 applies its brushing operation repeatedly on the surface of the endless belt 1 after separation of the fabric 5 therefrom. This repeated brushing operation allows any residues left on the surface of the endless belt 1, such as ink, fluff and yarn waste, to be physically scraped therefrom, while the suction nozzle 13 located downstream of the cleaning brush 12 sucks the residues together with the cleaning solution used to facilitate the scraping of the residues. This configuration of the cleaning device 10 according to the present invention allows reduction in the amount of the cleaning solution required for the removal of such residues left on the surface of the endless belt 1.

Accordingly, the cleaning device 10 of the present invention is capable of efficiently removing not only liquid materials left on the surface of the endless belt 1, such as ink, color paste and cleaning water waste, but also solid materials stuck onto the belt surface, such as fluff, yarn and dust, derived from the fabric 5, which constitute a significant problem in inkjet printing.

In addition, the cleaning device 10, according to the present invention, can be made to a small size and compact structurally, allowing the reduction in space for its installation. Furthermore, the cleaning brush 12 and suction nozzle 13 of the present invention are highly durable, enabling minimized necessity for the replacement, which, in turn, allows the maintenance to be improved to a great extent.

The cleaning device 10 of the present invention, as described herein earlier, is designed so that its cleaning brush 12 and suction nozzle 13 move back and forth on the endless belt 1 in the direction at right angles to that of the conveyance of the belt. According to the present invention, the frequency or cycle of the back and forth movements of the cleaning device 10 on the endless belt 1 can be changed properly according to the efficiency of removing the residues left on the surface of the endless belt 1. During the back and forth movements of the cleaning device 10 on the endless belt 1, the cleaning brush 12, according to the present invention, can be moved slightly in the direction in which the endless belt 1 is conveyed. In addition, according to the present invention, the cleaning device 10 can be moved back and forth on the endless belt 1 in the direction diagonal to that of the conveyance of the endless belt 1.

The cleaning brush 12 and suction nozzle 13 of the present invention may be constructed either as one part or two separated parts, provided that both are preferably located as close as possible to allow the suction nozzle 13 to suck efficiently the residues scraped by the cleaning brush 12 from the surface of the endless belt 1.

Figure 5:
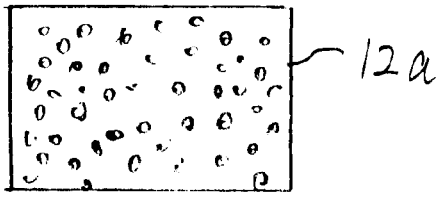
FIGS. 5 and 6 are plan views for showing cleaning devices used in the cleaning means.
Figure 6:
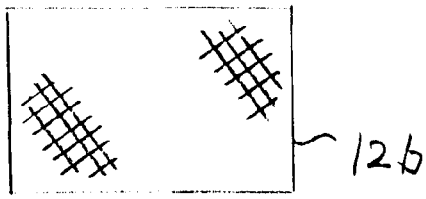

In the present invention, instead of the cleaning brush 12, a porous structure 12*a*, such as sponge, as shown in FIG. 5, or a fibrous structure 12*b*, such as thick cloth, as shown in FIG. 6, may be used for cleaning the surface of the supporting means.

According to the present invention, a water absorbing roll equipped with cotton cloth or other similar absorber can be provided downstream of the suction nozzle, if necessary, to remove more efficiently water left on the endless belt 1.

As described above, the present invention provides a cleaning device having suction means to remove not only liquid materials left on the surface of the supporting means, such as printing ink and cleaning water waste, after detachment of the recording medium therefrom, but also solid materials stuck onto the belt surface, such as fluff, yarn and dust, derived from the recording medium. In addition, since the suction means does not contact the surface of the supporting medium for removal of any residues left thereon, the suction means does not cause damage to the sticky layer. In addition, the cleaning means of the present invention can be formed to a small size and compact structurally, allowing space saving and cost reduction. Also, since the cleaning means is highly durable, it minimizes the necessity for its replacement and thus improving its maintenance.

While the invention has been explained with reference to the specific embodiments of the invention, the explanation is illustrative and the invention is limited only by the appended claims.

What is claimed is:

1. An inkjet printer comprising:

supporting means for conveying a recording medium to be stuck onto a surface thereof, printing means for ejecting ink onto the recording medium disposed on the surface of the supporting means, and cleaning means for washing the surface of the supporting means after detachment of the recording medium therefrom, said cleaning means including a nozzle for supplying a cleaning solution, a washing structure contacting the surface of the supporting means for washing the same, said washing structure being disposed under the nozzle and receiving the cleaning solution from the nozzle, and suction means disposed under the washing structure for sucking residues left on the surface of the supporting means after washing for removal of the residues, said cleaning means moving back and fourth in a direction of crossing a width of the supporting means for cleaning a substantially entire width of the supporting means.

2. An inkjet printer as claimed in claim 1, wherein said washing structure is a brush for washing the surface of the supporting means.

3. An inkjet printer as claimed in claim 1, wherein said washing structure is a porous structure for cleaning the surface of the supporting means.

4. An inkjet printer as claimed in claim 1, wherein said washing structure is a fibrous structure for cleaning the surface of the supporting means.

5. An inkjet printer as claimed in claim 1, wherein said suction means includes a suction nozzle with a tip facing the surface of said supporting means.

6. An inkjet printer as claimed in claim 1, wherein said cleaning means is moved back and forth across said supporting means at a speed of 10 to 10 mm/sec.

7. An injet printer as claimed in claim 1, further comprising a frame arranged perpendicularly to the supporting means and moved in the width direction of the supporting means, said frame supporting the cleaning means.

8. An inkjet printer as claimed in claim 7, further comprising a spring situated between the frame and the washing structure to urge the washing structure to the supporting means at a predetermined pressure.

9. An inkjet printer as claimed in claim 8, wherein said nozzle and suction means are spaced apart from the support means, respectively.

* * * * *

UNITED STATES PATENT AND TRADEMARK OFFICE

CERTIFICATE OF CORRECTION

PATENT NO. : 6,511,152 B2
DATED : January 28, 2003
INVENTOR(S) : Tsuyomi Yoshimura It is certified that error appears in the above-identified patent and that said Letters Patent is hereby corrected as shown below:

Title page,
Item [65], Prior Publication Data, "US 2001/0028372 A1 Oct. 11, 2001", add
-- [30] Foreign Application Priority Data, March 30, 2000 (JP) ….2000-093644 --.

Signed and Sealed this

Tenth Day of June, 2003

JAMES E. ROGAN
*Director of the United States Patent and Trademark Office*